US009890447B2

(12) United States Patent
Dubach et al.

(10) Patent No.: US 9,890,447 B2
(45) **Date of Patent: *Feb. 13, 2018**

(54) ZIRCONIUM-BASED AND BERYLLIUM FREE SOLID AMORPHOUS ALLOY

(71) Applicant: The Swatch Group Research and Development Ltd, Marin (CH)

(72) Inventors: Alban Dubach, Bienne (CH); Yves Winkler, Schmitten (CH); Tommy Carozzani, Neuchatel (CH)

(73) Assignee: The Swatch Group Research and Development Ltd, Marin (CH)

( * ) Notice: Subject to any disclaimer, the term of this patent is extended or adjusted under 35 U.S.C. 154(b) by 194 days.

This patent is subject to a terminal disclaimer.

(21) Appl. No.: 14/769,580

(22) PCT Filed: Nov. 11, 2014

(86) PCT No.: PCT/EP2014/074283

§ 371 (c)(1),
(2) Date: Aug. 21, 2015

(87) PCT Pub. No.: WO2015/082175

PCT Pub. Date: Jun. 11, 2015

(65) Prior Publication Data

US 2016/0010194 A1 Jan. 14, 2016

(30) Foreign Application Priority Data

Dec. 6, 2013 (EP) ..... 13196050

(51) Int. Cl.
*C22C 45/10* (2006.01)
*C22C 16/00* (2006.01)
*A44C 27/00* (2006.01)

(52) U.S. Cl.
CPC ..... *C22C 45/10* (2013.01); *A44C 27/001* (2013.01); *C22C 16/00* (2013.01); *C22C 2200/02* (2013.01)

(58) Field of Classification Search
None
See application file for complete search history.

(56) References Cited

U.S. PATENT DOCUMENTS

| | | | | |
|---|---|---|---|---|
| 5,803,996 | A | 9/1998 | Inoue et al. | |
| 5,980,652 | A | 11/1999 | Inoue et al. | |
| 6,231,697 | B1 | 5/2001 | Inoue et al. | |
| 6,521,058 | B1 * | 2/2003 | Inoue | C22C 45/10 148/403 |
| 2002/0053375 | A1 | 5/2002 | Hays | |
| 2004/0050458 | A1 | 3/2004 | Hays | |
| 2004/0238077 | A1 | 12/2004 | Kuehn et al. | |
| 2008/0190521 | A1 * | 8/2008 | Loffler | C22C 45/10 148/538 |
| 2011/0162795 | A1 * | 7/2011 | Pham | B23K 13/01 156/309.9 |

FOREIGN PATENT DOCUMENTS

| | | | |
|---|---|---|---|
| CN | 101 314 838 | A | 12/2008 |
| EP | 0 905 268 | A1 | 3/1999 |
| EP | 0 905 269 | A1 | 3/1999 |
| WO | WO 01/83841 | A1 | 11/2001 |

OTHER PUBLICATIONS

International Search Report dated Mar. 30, 2015, in PCT/EP2014/074283 filed Nov. 11, 2014.

U. Kuhn et al., "As-case quasicrystalline phase in a Zr-based multicomponent bulk alloy", Applied Physics Letters, vol. 77, No. 20, (Nov. 13, 2000), pp. 3176-3176, XP012026644.

* cited by examiner

*Primary Examiner* — George Wyszomierski
(74) *Attorney, Agent, or Firm* — Oblon, McClelland, Maier & Neustadt, L.L.P.

(57) ABSTRACT

The invention concerns a zirconium and/or hafnium based, beryllium free, solid, amorphous alloy, with the addition of silver and/or gold and/or platinum to increase its critical diameter.

20 Claims, 1 Drawing Sheet

ZIRCONIUM-BASED AND BERYLLIUM FREE SOLID AMORPHOUS ALLOY

This application is a U.S. national-stage filing of PCT/EP2014/074283, filed Nov. 11, 2014, which claims benefit of Europe 13196050.2, filed Dec. 6, 2013. The entire disclosures of the two patent applications mentioned above are hereby incorporated by reference.

FIELD OF THE INVENTION

The invention concerns a solid amorphous alloy.

The invention further concerns a timepiece component made of this type of alloy.

The invention concerns the fields of horology and jewellery, in particular for the following structures: watch cases, case middles, main plates, bezels, push-buttons, crowns, buckles, bracelets, rings, earrings and others.

BACKGROUND OF THE INVENTION

Amorphous alloys are increasingly used in the fields of horology and jewellery, in particular for the following structures: watch cases, case middles, main plates, bezels, push-buttons, crowns, buckles, bracelets, rings, earrings and others.

Components for external use, intended to be in contact with the user's skin, must obey certain constraints, due, in particular to the toxicity or allergenic effects of some metals, especially beryllium and nickel. Despite the specific intrinsic properties of such metals, endeavours are made to market alloys containing little or no beryllium or nickel, at least for components likely to come into contact with the user's skin.

Zirconium-based solid amorphous alloys have been known since the 1990s. The following publications concern such alloys:

[1] Zhang, et al., Amorphous Zr—Al—TM (TM=Co, Ni, Cu) Alloys with Significant Supercooled Liquid Region of Over 100 K, Materials Transactions, JIM, Vol. 32, No. 11 (1991) pp. 1005-1010.

[2] Lin, et al., Effect of Oxygen Impurity on Crystallization of an Undercooled Bulk Glass Forming Zr—Ti—Cu—Ni—Al Alloy, Materials Transactions, JIM, Vol. 38, No. 5 (1997) pp. 473-477.

[3] U.S. Pat. No 6,592,689.

[4] Inoue, et al., Formation, Thermal Stability and Mechanical Properties of Bulk Glassy Alloys with a Diameter of 20 mm in Zr—(Ti,Nb)—Al—Ni—Cu System, Materials Transactions, JIM, Vol. 50, No. 2 (2009) pp. 388-394.

[5] Zhang, et al., Glass-Forming Ability and Mechanical Properties of the Ternary Cu—Zr—Al and Quaternary Cu—Zr—Al—Ag Bulk Metallic Glasses, Materials Transactions, Vol. 48, No. 7 (2007) pp. 1626-1630.

[6] Inoue, et al., Formation of Icosahedral Quasicristalline Phase in Zr—Al—Ni—Cu—M (M=Ag,Pd,Au or Pt) Systems, Materials Transactions, JIM, Vol. 40, No. 10 (1999) pp. 1181-1184.

[7] Inoue, et al., Effect of Additional Elements on Glass transition Behavior and Glass Formation tendency of Zr—Al—Cu—Ni Alloys, Materials Transactions, JIM, Vol. 36, No. 12 (1995) pp. 1420-1426.

Amorphous alloys with the best glass forming ability, known as and referred to hereafter as "GFA", are found in the following systems:

Zr—Ti—Cu—Ni—Be (for example LM1b, Zr44Ti11Cu9.8Ni10.2Be25), and Zr—Cu—Ni—Al.

Given the toxicity of beryllium, alloys containing beryllium cannot be used for applications involving contact with skin, such as external watch parts or suchlike. However, zirconium-based, beryllium free amorphous alloys generally exhibit a critical diameter which is lower than that of alloys containing beryllium, which is unfavourable for making solid parts. The best composition in terms of critical diameter ($D_c$) and the difference $\Delta T_x$ between the crystallisation temperature $T_x$ and the vitreous transition temperature $T_g$ (supercooled liquid region) in the Zr—Cu—Ni—Al system is the alloy $Zr_{65}Cu_{17.5}Ni_{10}Al_{7.5}$ [1].

Modifications are also known wherein the GFA has been improved by adding titanium and/or niobium:

$Zr_{52.5}Cu_{17.9}Ni_{14.6}Al_{10}Ti_5$ (Vit105) [2]

$Zr_{57}Cu_{15.4}Ni_{12.6}Al_{10}Nb_5$ (Vit106) and $Zr_{58.5}CU_{15.6}Ni_{12.8}Al_{10.3}Nb_{2.8}$ (Vit106a) [3]

$Zr_{61}Cu_{17.5}Ni_{10}Al_{7.5}Ti_2Nb_2$ [4]

In general, the addition of titanium and/or niobium increases the critical diameter of alloys, however the modification greatly decreases the gradient $\Delta T_x$ and therefore the process window for any hot deformation of such alloys. Further, given its very high melting temperature (2468° C.), niobium is not easy to melt, which complicates fabrication of a homogeneous alloy.

It is also known that adding silver to ternary Zr—Cr—Al alloys increases critical diameter, especially for modifications of the composition $Zr_{46}Cu_{46}Al_8$, for example $Zr_{42}Cu_{42}Al_8Ag_8$ [5].

However, due to the high level of copper and the absence of nickel, these alloys are not very resistant to corrosion and even tend to become discoloured (and/or turn black) over time at ambient temperature.

Further, it is known that adding more than 5% silver, gold, palladium or platinum to Zr—Cu—Ni—Al amorphous alloys stimulates the formation of quasicrystals during devitrification of such alloys by a heat treatment between $T_g$ and $T_x$ [6].

In publication [7], the effect of an additional element M (M=Ti, Hf, V, Nb, Cr, Mo, Fe, Co, Pd or Ag) on the GFA of a Zr—Cu—Ni—Al—M alloy was tested.

The results demonstrate that only titanium, niobium and palladium increase the critical diameter of the alloy, yet also greatly decrease the gradient $\Delta T_x$. No particular effect is cited as regards the addition of silver to the alloy.

The documents below include zirconium based alloys with silver or gold.

U.S. Pat. Nos. 5,980,652 and 5,803,996 describe alloys of the following type:

$Zr_{bar}$-(Ti, Hf,Al,Ga)$_{5-20}$-(Fe, Co, Ni,Cu)$_{20-40}$-(Pd, Pt,Au, Ag)$_{0-10}$ and more particularly alloys with palladium and/or platinum, a single example citing the addition of 1% gold or 1% silver, with no evaluation of the effect of this addition on the increase in critical diameter.

EP Patent No 0905268 describes alloys of the following type:

(Zr, Hf)$_{25-85}$-(Ni, Cu, Fe, Co, Mn)$_{5-70}$-Al$_{0-35}$-T$_{>0-15}$ where T is an element with a negative enthalpy of mixing with one of the other elements, and is chosen from the following group: T=Ru, Os, Rh, Ir, Pd, Pt, V, Nb, Ta, Cr, Mo, W, Au, Ga, Ge, Re, Si, Sn or Ti. This document only gives one example with palladium. It does not demonstrate any positive effect of elements T on $D_c$ and $\Delta T_x$.

EP Patent No 0905269 describes a method of manufacturing a multi-phase alloy (14-23% crystalline phase in an amorphous matrix) by a heat treatment of $Zr_{25-85}$-(Ni, Cu)$_{5-70}$-Al$_{>0-35}$-Ag$_{>0-15}$.

CN Patent No 101314838 describes alloys of the following type:

$Zr_{41-63}$-$Cu_{18-46}$-$Ni_{1.5-12.5}$-$Al_{4-15}$-$Ag_{1.5-26}$

In short, little is known about the effects of adding a low concentration of silver or gold to such amorphous alloys, and such effects have not been subject to any particular investigation in the literature.

SUMMARY OF THE INVENTION

The invention proposes to increase the critical diameter of zirconium based, beryllium free, amorphous alloys, while maintaining a high ΔTx value.

The invention concerns a zirconium and/or hafnium based, beryllium free, solid, amorphous alloy, with the addition of silver and/or gold and/or platinum to increase its critical diameter.

To this end, the invention concerns a solid amorphous alloy, characterized in that it is beryllium free and consists, in atomic percent values, of:

- a base composed of zirconium and/or hafnium, with the total zirconium and hafnium having a minimum value of 50% and a maximum value of 63%;
- a first additional metal, the total value of said at least a first additional metal or said first additional metals being comprised (minimum and maximum values included) between: a minimum value of 0% and maximum value of 0.5%, said at least a first additional metal being selected from a first group comprising niobium and tantalum, the niobium content being less than or equal to 0.5%;
- a second additional metal, the total value of said at least one second additional metal or said second additional metals being comprised (minimum and maximum values included) between: a minimum value of 1.2% and maximum value of 4.5%, said at least one second additional metal being selected from a second group comprising silver, gold and platinum;
- a third additional metal, the total value of said at least one third additional metal or said third additional metals being comprised (minimum and maximum values included) between: a minimum value of 8.5% and maximum value of 17.5%, said at least one third additional metal being selected from a third group comprising nickel, cobalt, manganese and iron;
- aluminium: minimum value 9%, maximum value 13%;
- copper and inevitable impurities: the complement to 100%, but less than or equal to 18%.

More specifically, the base composed of zirconium and/or hafnium, has a total zirconium and hafnium content with a minimum value of 57% and a maximum value of 63%;

The invention further concerns a timepiece or jewellery component made of this type of alloy.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
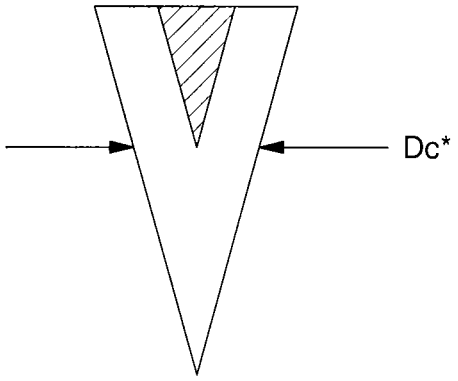
FIG. 1 shows a schematic view of a critical diameter measurement in a conical sample.
Figure 2:
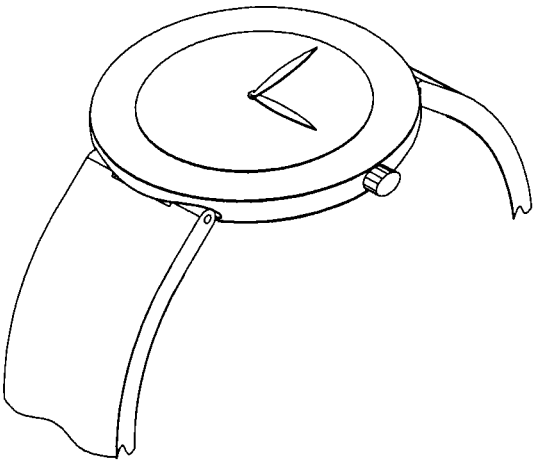
FIG. 2 shows a schematic view of a timepiece made of an alloy according to the invention.

The invention concerns the fields of horology and jewellery, in particular for the following structures: watch cases, case middles, main plates, bezels, push-buttons, crowns, buckles, bracelets, rings, earrings and others.

The invention proposes to produce beryllium free amorphous steels, devised to have similar properties to those of amorphous alloys containing beryllium. Hereafter, an alloy containing no beryllium will be termed a "beryllium free alloy" and an alloy containing less than 0.5 atomic percent of nickel will be termed a "nickel free alloy".

"Containing no beryllium" means that the level of beryllium is preferably zero, or very low, the same as impurities, and preferably less than or equal to 0.1%.

It is therefore sought to manufacture alloys, which include substitution elements for beryllium, and which have high values of critical diameter $D_c$ and gradient ΔTx.

The invention further concerns a zirconium based, beryllium free, solid, amorphous alloy, with the addition of silver and/or gold and/or platinum to increase the critical diameter $D_c$.

More specifically, the invention concerns a solid amorphous alloy, characterized in that it contains no beryllium and in that it consists, in atomic percent values, of:

- a base composed of zirconium and/or hafnium, with the total zirconium and hafnium having a minimum value of 50% and a maximum value of 63%;
- a first additional metal, the total value of said at least a first additional metal or said first additional metals being comprised (minimum and maximum values included) between: a minimum value of 0.0% and maximum value of 0.5%, said at least a first additional metal being selected from a first group comprising niobium and tantalum, the niobium value being less than or equal to 0.5%;
- a second additional metal, the total value of said at least one second additional metal or said second additional metals being comprised (minimum and maximum values included) between: a minimum value of 1.2% and maximum value of 4.5%, said at least one second additional metal being selected from a second group comprising silver, gold and platinum;
- a third additional metal, the total value of said at least one third additional metal or said third additional metals being comprised (minimum and maximum values included) between: a minimum value of 8.5% and maximum value of 17.5%, said at least one third additional metal being selected from a third group comprising nickel, cobalt, manganese and iron;
- aluminium: minimum value 9%, maximum value 13%;
- copper and inevitable impurities: the complement to 100%, but less than or equal to 18%.

More specifically, the base composed of zirconium and/or hafnium, has a total zirconium and hafnium content with a minimum value of 57% and a maximum value of 63%;

Although numerous zirconium based amorphous compositions are known, the development of an amorphous alloy according to the composition of the invention produces an effect which is novel and extremely surprising, since in particular 2% of an additive is sufficient to significantly increase the critical diameter.

The effect of the range 1.2% to 4.5% of the second additional metal chosen from a second group including silver, gold and platinum is clear: the addition to the alloy of one or the other, or of several, of these elements increases the critical diameter in comparison to an alloy that does not contain these additives, without decreasing the gradient ΔTx.

A transition area showing a negative gradient of the critical diameter starts at around 4.5% and, beyond 5%, the critical diameter is significantly reduced with respect to the optimum quantity which is comprised (minimum and maximum values included) between the lower threshold of 1.2%, where the influence of the addition of the second additional metal starts to be seen, and the upper threshold of 4.5%.

The range from 1.2% to 4.0% is favourable, and very good results have been obtained in the range from 1.5% to 3.8% and more particularly still in proximity to 2.8% in the range from 2.6% to 3.0%.

More specifically, the gold content is between 1.5% and 2.5%.

More specifically, the platinum content is between 1.5% and 2.5%.

More specifically, the silver content is between 1.0% and 3.8%.

In a specific embodiment, the total zirconium and hafnium content in the base is limited to 60%.

In a specific variant, the alloy according to the invention does not contain titanium.

In a specific variant, the alloy according to the invention does not contain niobium.

In a specific variant, the alloy according to the invention does not contain either titanium or niobium.

Palladium did not demonstrate any positive effect during the development of the invention, unlike the metals of the second group: silver, gold and platinum. It is possible to include palladium in this second group, but its content should preferably remain very low, in particular less than or equal to 1.0%.

A non-limiting example embodiment is described hereafter: alloy charges of around 70 g are prepared in an arc furnace using pure elements (purity of more than 99.95%). The pre-alloy thereby obtained is then melted again in a centrifugal casting machine and cast in a copper mould in the shape of a cone (maximum thickness 11 mm, width 20 mm, opening angle 6.3°).

A DSC measurement is made of the vitreous transition and crystallisation temperature on samples taken from the end of each cone. A metallographic cut is made in the middle of each cone lengthways to measure the critical diameter $D_c$*, wherein $D_c$* is the thickness of the cone at the place where the crystalline area starts, as seen in FIG. 1.

The following table summarises the test carried out (the compositions in italics are compositions known in the literature). It can be seen that with the proper quantity of silver, gold or platinum additive, the critical diameter Dc* can be increased significantly in comparison to basic alloys which do not contain these additives. Further, these additives do not decrease the gradient $\Delta t_x$.

| Alloy | $T_g$ | $T_x$ | $\Delta T_x$ | $D_c$* |
|---|---|---|---|---|
| *Zr65Cu15Ni10Al10* | *374* | *478* | *104* | *4.9* |
| Zr65Cu13Ag2Ni10Al10 | 371 | 471 | 100 | 5.5 |
| Zr65Cu11.5Ag3.Ni10Al10 | 383 | 453 | 70 | 4.2 |
| Zr65Cu10Ag5Ni10Al10 | 375 | 439 | 64 | 5.2 |
| Zr63Cu15Ag2Ni10Al10 | 380 | 496 | 116 | 5.8 |
| Zr62Cu15Ag3Ni10Al10 | 388 | 504 | 116 | 8.6 |
| *Zr61Ti2Nb2Cu17.5Ni10Al7.5* | *378* | *447* | *69* | *8.5* |
| Zr61Cu17.5Ag4Ni10Al7.5 | 382 | 490 | 108 | 6.8 |
| *Zr58.5Cu15.6Ni12.8Al10.3Nb2.8* | *409* | *497* | *88* | *5.7* |
| Zr59.1Cu15.75Ni12.95Al10.40Ag1.8 | 398 | 502 | 104 | 4.9 |
| Zr58.5Cu15.6Ni12.8Al10.3Ag2.8 | 400 | 498 | 98 | 8.6 |
| Zr57.9Cu15.44Ni12.67Al10.19Ag3.8 | 394 | 503 | 109 | 8.1 |
| Zr58.5Cu15.6Ni12.8Al10.3Pd2.8 | 409 | 507 | 98 | 5.1 |
| *Zr52.5Ti5Cu17.9Ni14.6Al10* | *404* | *459* | *55* | *6.8* |
| Zr52.5Ti2.5Cu17.9Ni14.6Al12.5 | 420 | 510 | 90 | 6.3 |
| Zr52.5Ti3.4Cu17.9Ni14.6Al11.6 | 418 | 501 | 83 | 6.6 |

-continued

| Alloy | $T_g$ | $T_x$ | $\Delta T_x$ | $D_c$* |
|---|---|---|---|---|
| Zr52.5Ti2.5Cu15.9Ag2Ni14.6Al12.5 | 422 | 514 | 92 | >11 |
| Zr52.5Ti2.5Cu15.9Au2Ni14.6Al12.5 | 426 | 512 | 86 | >11 |
| Zr52.5Ti2.5Cu15.9Pt2Ni14.6Al12.5 | 430 | 494 | 64 | 9.0 |
| Zr52.5Ti2.5Cu15.9Ni14.6Pd2Al12.5 | 412 | 488 | 76 | 5.2 |
| Zr52.5Ti2.5Cu17.9Ni12.6Pd2Al12.5 | 423 | 496 | 73 | 6.9 |
| Zr52.5Ti2.5Cu16.9Ag1Ni14.6Al12.5 | 423 | 512 | 89 | >11 |
| Zr52.5Ti2.5Cu14.9Ag3Ni14.6Al12.5 | 418 | 508 | 90 | >11 |
| Zr52.5Nb2.5Cu15.9Ag2Ni14.6Al12.5 | 438 | 523 | 85 | >11 |

More specifically, the following alloys have given particularly satisfactory results:

Zr62Cu15Ag3Ni10$Al_{10}$,
Zr58.5Cu 15.6Ni 12.8A110.3Ag2.8,
Zr57.9Cu15.44Ni12.67A110.9Ag3.8
Zr52.5Ti2.5Cu15.9Ag2Ni14.6Al12.5
Zr52.5Ti2.5Cu15.9Au2Ni14.6Al12.5
Zr52.5T12.5Cu15.9Pt2Ni14.6Al12.5
Zr52.5T12.5Cu16.9Ag1Ni14.6Al12.5
Zr52.5T12.5Cu14.9Ag3Ni14.6Al12.5
Zr52.5Nb2.5Cu15.9Ag2Ni14.6Al12.5

A first favourable sub-family concerns a total zirconium and hafnium content of more than 57.0%, with a total first additional metal content of less than or equal to 0.5%.

A second favourable sub-family concerns a total zirconium and hafnium content of less than or equal to 53.0%, with a total first additional metal content of between 2.0% and 3.0%.

In other variants of the invention, other elements, such as iron and manganese, are incorporated.

The search for a compromise makes it possible to identify the best composition, in particular with an ideal silver content, which is advantageous due its cost which is lower than or equal to that of gold and platinum, yet provides the required effects.

To optimise the alloy, several rules were determined during experiments: Particularly favourable results were obtained with:

- a ratio of the content of zirconium to the content of copper: Zr/Cu, of between 3.0 and 5.0;
- a ratio of the content of zirconium to the total content of copper and nickel: Zr/(Cu+Ni) of between 1.5 and 3.0;
- a ratio of the total content of zirconium, hafnium, titanium, niobium and tantalum to the total content of copper and nickel: (Zr,Hf,Ti,Nb,Ta)/(Cu+Ni) of between 1.5 and 3.0;
- the total value of said at least one first additional metal or said first additional metals (minimum and maximum values included) of between: a minimum value of 2.5% and a maximum value of 4.5%;
- an aluminium content of more than 10.0%.

The question of incorporating nickel in the alloy arises because of the allergenic effects of nickel taken on its own or in an alloy composition containing certain other metals. However, the presence of nickel in an amorphous alloy is favourable for obtaining zirconium based amorphous alloys with high critical diameters and good anti-corrosion properties. By analogy, stainless steels also contain a high nickel content, and are widely used in jewellery and horology.

The important constraint to be observed is that the alloy obtained satisfies the nickel release test in conformity with EN1811.

In a particular variant of the invention, the alloy includes less than 0.5% nickel.

It is understood that it is not sufficient simply to replace nickel with another metal to obtain the equivalent characteristics. The elements having a close atomic radius are iron, cobalt, palladium, manganese and chromium. This therefore means rethinking the entire composition of the amorphous alloy.

Thus, the invention concerns a second solid amorphous alloy, characterized in that it contains no beryllium and in that it consists, in atomic percent values, of:

- a base composed of zirconium and/or hafnium, with the total zirconium and hafnium having a minimum value of 50% and a maximum value of 63%;
- a first additional metal, the total value of said at least a first additional metal or said first additional metals being comprised (minimum and maximum values included) between: a minimum value of 0% and maximum value of 0.5%, said at least a first additional metal being selected from a first group comprising niobium and tantalum, the niobium value being less than or equal to 0.5%;
- a second additional metal, the total value of said at least one second additional metal or said second additional metals being comprised (minimum and maximum values included) between: a minimum value of 1.2% and maximum value of 4.5%, said at least one second additional metal being selected from a second group comprising silver, gold, palladium and platinum;
- a third additional metal, the total value of said at least one third additional metal or said third additional metals being comprised (minimum and maximum values included) between: a minimum value of 8.5% and maximum value of 17.5%, said at least one third additional metal being selected from a third group comprising chromium, cobalt, manganese and iron;
- aluminium: minimum value 9%, maximum value 13%;
- copper and inevitable impurities: the complement to 100%, but less than or equal to 18%.

More specifically, the base composed of zirconium and/or hafnium, has a total zirconium and hafnium content with a minimum value of 57% and a maximum value of 63%;

More specifically, the gold content is between 1.5% and 2.5%.

More specifically, the platinum content is between 1.5% and 2.5%.

The invention also concerns a timepiece or jewellery component made of an alloy according to the invention, or a timepiece or piece of jewellery, particularly a watch, or a bracelet or suchlike.

The invention claimed is:

1. A beryllium-free solid amorphous alloy, consisting of, in atomic percentage:

- zirconium and/or hafnium as at least one base metal, wherein a total content of said at least one base metal ranges from a minimum value of 50% to a maximum value of 63%;
- at least one first additional metal, wherein a total content of said at least one first additional metal ranges from a minimum value of 0% to a maximum value of 0.5%, said at least a first additional metal is selected from the group consisting of niobium and tantalum, and a content of niobium is less than or equal to 0.5%;
- at least one second additional metal, wherein a total content of said at least one second additional metal ranges from a minimum value of 1.2% to a maximum value of 4.5%, said at least one second additional metal is selected from the group consisting of, gold and platinum;
- at least one third additional metal, wherein a total content of said at least one third additional metal ranges from a minimum value of 8.5% to a maximum value of 17.5%, said at least one third additional metal is selected from the group consisting of nickel, cobalt, manganese, and iron;
- aluminium ranging from a minimum value of 9% to a maximum value of 13%;
- copper ranging from a minimum of value of 10% to a maximum value of 17.5%; and
- inevitable impurities,
- wherein the alloy has $\Delta T_x$ as calculated below of 98 K or less:

$\Delta T_x = T_x - T_g$, where $T_x$ and $T_g$ is a crystallization point and a glass transition point of the alloy, respectively.

2. The alloy according to claim 1, wherein the total content of said at least one base metal ranges from a minimum value of 57% to a maximum value of 63%.

3. The alloy according to claim 1, wherein the total content of said at least one second additional metal in atomic percentage ranges from a minimum value of 1.2% to a maximum value of 4.0%.

4. The alloy according to claim 3, wherein the total content of said at least one second additional metal in atomic percentage ranges from a minimum value of 1.5% to a maximum value of 3.8%.

5. The alloy according to claim 4, wherein the total content of said at least one second additional metal in atomic percentage ranges from a minimum value of 2.6% to a maximum value of 3.0%.

6. The alloy according claim 1, wherein gold is present as the at least one second additional metal, and a content of gold in atomic percentage ranges from a minimum value of 1.5% to a maximum value of 2.5%.

7. The alloy according to claim 1, wherein platinum is present as the at least one second additional metal, and a content of platinum in atomic percentage ranges from a minimum value of 1.5% to a maximum value of 2.5%.

8. The alloy according to claim 1, wherein the total content of said at least one base metal is less than or equal to 60%.

9. The alloy according to claim 1, wherein a content of aluminium is more than 10.0%.

10. The alloy according to claim 1, wherein zirconium is present as the at least one base metal and a content ratio of zirconium to copper Zr/Cu ranges from a minimum value of 3.0 to a maximum value of 5.0.

11. The alloy according to claim 1, wherein zirconium is present as the at least one base metal and a content ratio of zirconium to copper and nickel in total Zr/(Cu+Ni) ranges from a minimum value of 1.5 to a maximum value of 3.0.

12. The alloy according to claim 1, wherein a content ratio of zirconium, hafnium, niobium, and tantalum in total to copper and nickel in total (Zr+Hf+Nb+Ta)/(Cu+Ni) ÷ranges from a minimum value of 1.5 to a maximum value of 3.0.

13. The alloy according to claim 1, wherein said alloy does not contain niobium.

14. The alloy according to claim 1, wherein neither titanium nor niobium is present in said alloy.

15. The alloy according to claim 1, wherein the alloy includes less than 0.5% nickel in atomic percentage.

16. A timepiece or jewellery component, comprising the alloy according to claim 1.

17. A beryllium-free solid amorphous alloy, consisting of, in atomic percentage:

zirconium and/or hafnium as at least one base metal, wherein a total content of said at least one base metal ranges from a minimum value of 50% to a maximum value of 63%;

at least one first additional metal, wherein a total content of said at least one first additional metal ranges from a minimum value of 0% to a maximum value of 0.5%, said at least a first additional metal is selected from the group consisting of niobium and tantalum, and a content of niobium is less than or equal to 0.5%;

at least one second additional metal, wherein a total content of said at least one second additional metal ranges from a minimum value of 1.2% to a maximum value of 4.5%, said at least one second additional metal is selected from the group consisting of, gold, palladium, and platinum;

at least one third additional metal, wherein a total content of said at least one third additional metal ranges from a minimum value of8.5% to a maximum value of 17.5%, said at least one third additional metal is selected from the group consisting of chromium, cobalt, manganese, and iron;

aluminium ranging from a minimum value of 9% to a maximum value of 13%;

copper ranging from a minimum of value of 10% to a maximum value of 17.5%; and inevitable impurities, wherein the alloy has $\Delta T_x$ as calculated below of 98 K or less:

$\Delta T_x = T_x - T_g$ where $T_x$ and $T_g$ is a crystallization point and a glass transition point of the alloy, respectively.

18. The alloy according to claim 17, wherein the total content of said at least one base metal ranges from a minimum value of 57% to a maximum value of 63%.

19. The alloy according to claim 17, wherein gold is present as the at least one second additional metal, and a content of gold in atomic percentage ranges from a minimum value of 1.5% to a maximum value of 2.5%.

20. The alloy according to claim 17, wherein platinum is present as the at least one second additional metal, and a content of platinum in atomic percentage ranges from a minimum value of 1.5% to a maximum value of 2.5%.

* * * * *